350-333 SR
11/15/82 XR 4,359,729

United States Patent [19]
Nonomura et al.

[11] 4,359,729
[45] Nov. 16, 1982

[54] MATRIX TYPE LIQUID CRYSTAL DISPLAY WITH FACULTIES OF PROVIDING A VISUAL DISPLAY IN AT LEAST TWO DIFFERENT MODES

[75] Inventors: Keisaku Nonomura, Nara; Keiichiro Shimizu; Hisashi Uede, both of Yamatokoriyama, all of Japan

[73] Assignee: Sharp Kabushiki Kaisha, Osaka, Japan

[21] Appl. No.: 952,206

[22] Filed: Oct. 17, 1978

[30] Foreign Application Priority Data

Oct. 18, 1977 [JP] Japan ..... 52/125508

[51] Int. Cl.³ ..... G09G 3/36
[52] U.S. Cl. ..... 340/765; 340/784; 340/812; 350/333
[58] Field of Search ..... 340/765, 784, 812; 350/332, 333

[56] References Cited

U.S. PATENT DOCUMENTS

| | | | |
|---|---|---|---|
| 3,776,615 | 12/1973 | Tsukamoto et al. | 340/784 |
| 3,883,778 | 5/1975 | Kaji et al. | 340/813 X |
| 3,922,667 | 11/1975 | Ueda et al. | 350/333 X |
| 3,955,187 | 5/1976 | Bigelow | 350/333 X |
| 3,975,726 | 8/1976 | Kawakami | 340/765 X |
| 4,044,346 | 8/1977 | Akahane et al. | 340/765 |
| 4,163,230 | 7/1979 | Konii | 340/784 X |

*Primary Examiner*—David L. Trafton
*Attorney, Agent, or Firm*—Birch, Stewart, Kolasch & Birch

[57] ABSTRACT

The disclosure is directed toward an XY matrix type liquid crystal. In the case where more than one kind of display pattern are to be displayed using substantially the same line or lines (a column or columns for a column sequential drive method), only line (or column) electrodes associated with a predetermined display are supplied with a voltage. The period of time where a voltage is applied per line or per column (that is, duty factor) is switched in accordance with a display pattern which is about to be displayed.

9 Claims, 5 Drawing Figures

FIG. 1
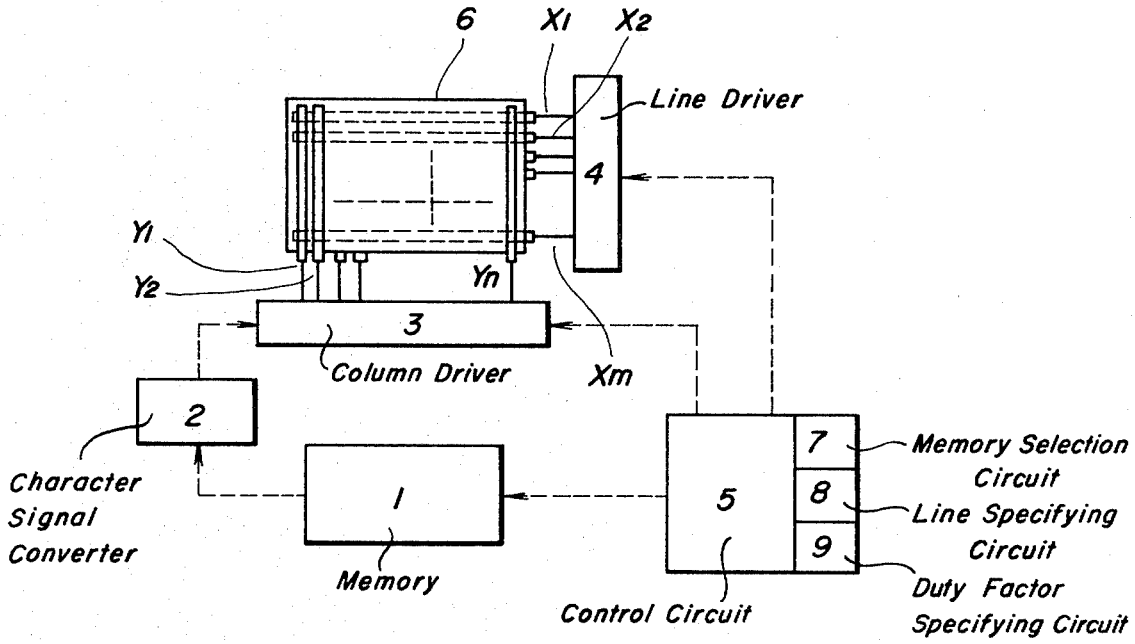
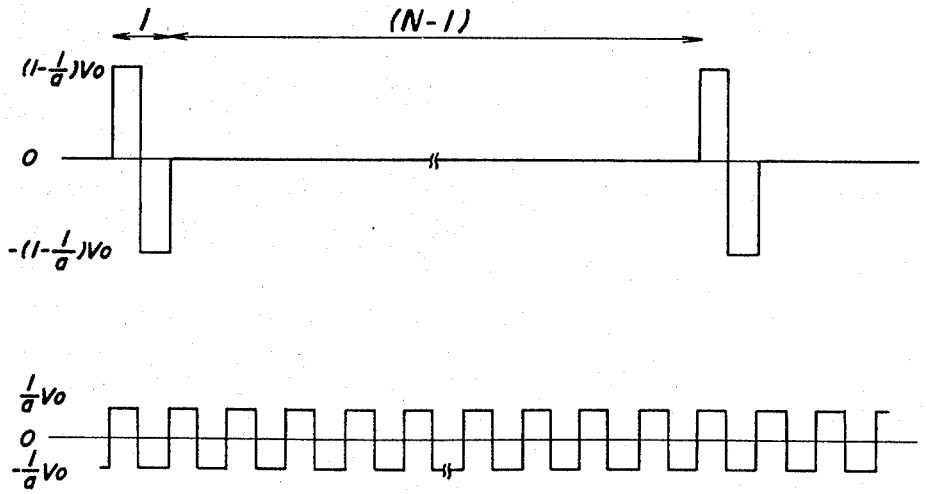
FIG. 4

MATRIX TYPE LIQUID CRYSTAL DISPLAY WITH FACULTIES OF PROVIDING A VISUAL DISPLAY IN AT LEAST TWO DIFFERENT MODES

BACKGROUND OF THE INVENTION

The present invention relates to a matrix type liquid crystal display panel which provides a visual display of intelligence signals such as digits, characters, symbols, patterns or the like through the use of a liquid crystal having an XY matrix type electrode structure consisting of a plurality of line electrodes and a plurality of column electrodes opposed thereto.

There are two basic types of electrode structure of a display panel utilizing a liquid crystal material or the like: the segment type and the XY matrix type. The former is useful to minimize the number of necessary display dots in displaying digits or the like of preselected shape and size but suffers from difficulties in providing various shapes and sizes of a display. Display panels of the matrix type, on the other hand, have relatively wide freedom in displaying different shapes and sizes of patterns.

In the case where the above mentioned matrix type of liquid crystal display is enabled by utilizing a conventional line sequential drive method, with an increase in the number of line electrodes (or column electrodes in a column sequential drive method), the period of time where a voltage is applied per line (or column), in other words, a duty factor, is shortened, presenting a cross-talk problem. A satisfactory contrast ratio is not available because a threshold voltage level of liquid crystal material is not definite and response thereof is dull. Several attempts to solve these problems have been suggested:

(I) the development of a liquid crystal material manifesting a swift response;

(II) the development of a liquid crystal material having definite threshold properties; and (III) the design of an enabling circuit which further develops a well known $\frac{1}{3}$ bias method into a 1/n bias method while allowing a wide range of an operating margin ($\alpha$:$V_{ON}/V_{OFF}$) by a proper selection of drive voltages of column signals and line signals depending upon the number of lines.

Although research activities have been directed toward both sides of new liquid crystal materials and drive methods, a high capacity, high contrast display has not, as a matter of fact, been reduced to practical use as yet.

A liquid crystal display is very attractive for use in a digital wristwatch thanks to the low power consumption and low cost features thereof. A prior art wristwatch display is normally of the segment type. These days, there is a great requirement for a digital display wristwatch with multi-faculties for storing monthly calenders or telephone numbers or the like and, if necessary, displaying these contents. There is further a trend to display not only digits but also alphabetical characters. The segment type can not accomplish such a trend nor could the XY matrix type provide a high contrast due to the above problems.

It is therefore an object of the present invention to provide an XY matrix type liquid crystal which is free of the above described problems. According to the present invention, in the case where more than one kind of display pattern is to be displayed using substantially the same line or lines (a column or columns for a column sequential drive method), only line (or column) electrodes associated with a predetermined display are supplied with a voltage. The period of time where a voltage is applied per line or per column (that is, a duty factor) is switched in accordance with a display pattern which is about to be displayed. As an alternate, a drive voltage may be switched in accordance with the number of lines used. As a result, a duty factor is kept at the maximum to ensure the highest contrast during display operation.

BRIEF DESCRIPTION OF THE DRAWINGS

Other objects and many of the attendant advantages of the present invention will be readily appreciated as the same becomes better understood by reference to the following detailed description which should be considered in conjunction with the accompanying drawings, and wherein:

FIG. 1 is a block diagram of a matrix type liquid crystal display panel driver embodying the present invention;

FIG. 4 represents a description of the 1/N bias method used with the present invention.

DETAILED DESCRIPTION OF THE INVENTION

Figure 2A:
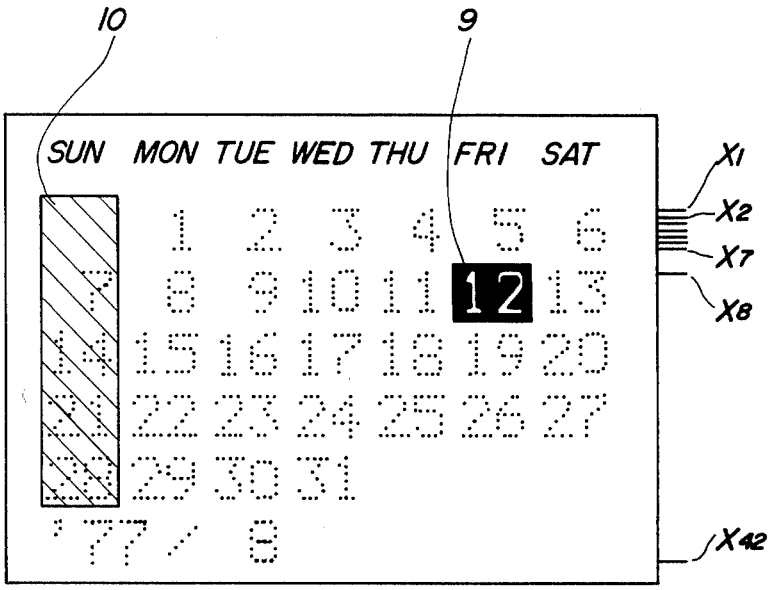
FIGS. 2(*a*) and 2(*b*) are a diagram of an example of application of the matrix type liquid crystal display panel of the present invention wherein FIG. 2(*a*) shows a display of a monthly calender and FIG. 2(*b*) a display of time and day of week.

Referring now to FIG. 1, there is illustrated a driver circuit for a display panel having a matrix type electrode structure. A main memory 1 stores data which is then converted into a display pattern through the use of a character signal converter 2. A display pattern is stored line by line in a buffer memory within a column driver circuit 3. The column driver circuit 3 supplies the signals contained in the buffer memory to the column electrodes $Y_1, Y_2, Y_3, \ldots Y_n$ at the same time.

The line electrodes $X_1, X_2, X_3 \ldots X_m$ crossing the column electrodes $Y_1, Y_2, Y_3, \ldots Y_n$, on the other hand, are sequentially enabled by a line driver circuit 4. Accordingly, information in the buffer memory within the column driver circuit 3 is displayed line by line. Information is introduced into a matrix display 6 and synchronizing signals are fed to the column driver circuit 3 and the line driver circuit 4, thereby providing a control for display operations. This display scheme is normally named a line sequential drive method.

According to the present invention, as seen from FIG. 1, there are further provided a memory selector circuit 7 within a control 5, a line specifying circuit 8 or specifying the number of lines used, and a duty factor specifying circuit 9 for determining a period of time where a voltage is applied to a respective one of the lines used.

Figure 2B:
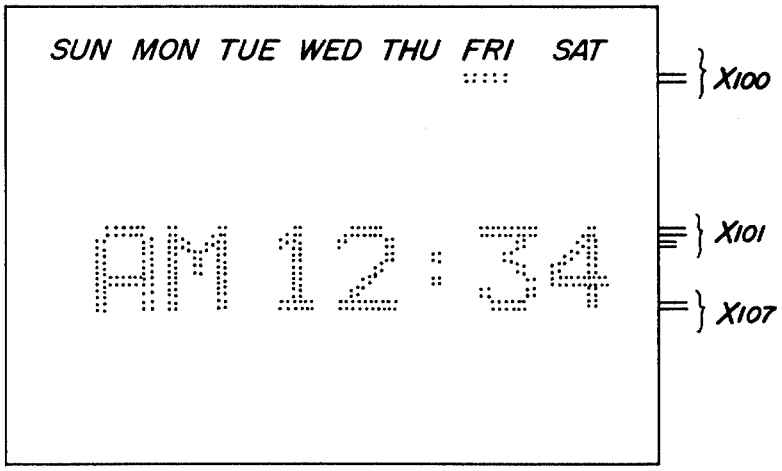

FIGS. 2*a* and 2*b* show an example of application of the present invention, which provides a visual display of a monthly calender, FIG. 2*a*, and a visual display of time and day of week, FIG. 2*b*. In other words, the matrix display operates on the two different display modes.

When it is desired to provide a display of a monthly calender as shown in FIG. 2(*a*), the memory selector circuit 7 picks up calender signals from the main memory 1. The line specifying circuit 8 specifies the line electrodes $X_1$–$X_{42}$ (in this case a display inclusive of year and month needs six characters in one line and needs a total of $7\times6=42$ lines.) The duty factor specifying circuit 5 selects a 1/42 duty factor as the period of time where a voltage is applied to a respective one of the lines. Then, the control 5 becomes operative to provide a display of the calender shown in FIG. 2(*a*).

On the other hand, when it is desired to provide a visual display of time and day of week, time and day of week signals are derived from the main memory 1 upon the action of the memory selector circuit 7. Since a display of time and day of week needs a few numbers of charactors (including symbols), it is possible to use every two line and column electrodes as a unit (each of picture elements consists of four display dots) in order to double in size a display pattern displayed on the matrix panel. One character consists of 5 columns$\times$7 lines electrodes. The line specifying circuit 8 instructs the line electrode $X_{100}$ to be selected and used while displaying day of week and the line electrodes $X_{101}$–$X_{107}$ to be selected and used while displaying time. In this case, it does not matter if a specific line electrode or electrodes are used commonly in both display modes (or, also in the calender display mode). The duty factor specifying circuit 9 specifies a $\frac{1}{8}$ duty factor (one for day of week display and seven for time display) as the period of time where a voltage is applied per line electrodes. The control circuit 5 provides a control for a display of time and day of week as shown in FIG. 2(*b*).

With the $\frac{1}{8}$ duty factor employed, a display of time and day of week is provided at a higher contrast and a greater dimension. Although a calender display is provided with the 1/42 duty factor and causes a somewhat lower contrast, it can be visually confirmed from a proper viewing angle as long as the TN-FEM (twisted nematic field effect mode) type liquid crystal is employed. It will be noted, however, that a calender display is required less frequently than a time and day of week display to the extent that a reduced contrast during the calender display is negligible.

Figure 3:
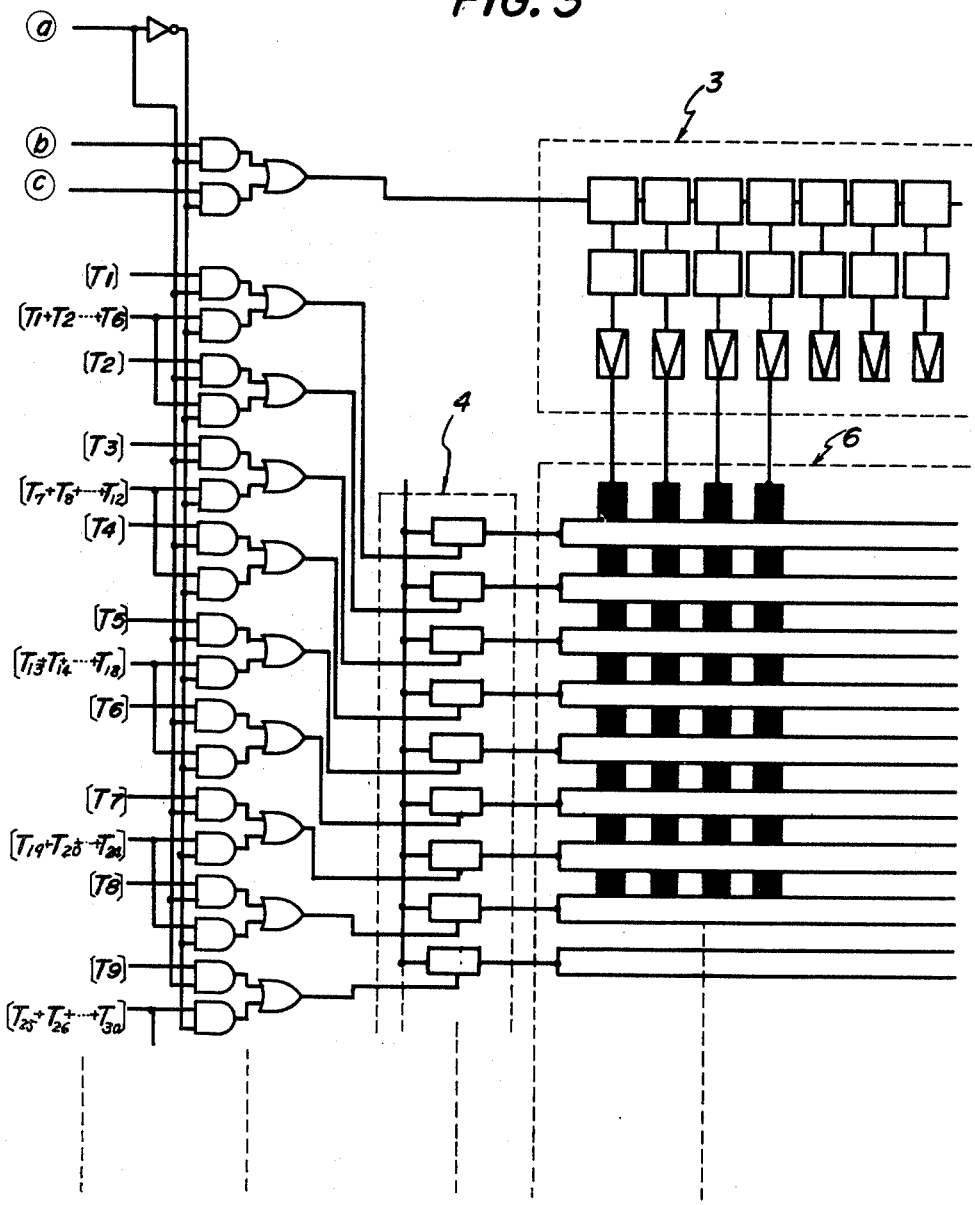
FIG. 3 is a logic diagram of a duty factor switching circuit used with the present invention.

The above described duty factor switching circuit 9 may be implemented with a well known logic circuit technique. A typical example of the duty factor circuit 9 is illustrated in FIG. 3, which comprises a column input terminal (b) for displaying a certain intelligence signal, a different column signal input terminal (c) for displaying a different intelligence signal and a terminal (a) for determining which of the contents (b) or (c) to be fed to the column selector circuit 3 and selecting the duty factor correspondingly. It will be noted that 30 sequentially phase shifted timing signals $T_1$ through $T_{30}$ are employed to practice the duty factor selection.

As an alternate, a drive voltage level may be changed in accordance with the number of the lines used, changing drive waveforms to ensure the highest contrast at all times.

A brief description of a 1/n bias method used with the present invention is viewed from FIG. 4 wherein (a) shows a voltage applied to the line electrode and (b) a voltage applied to the column electrode. N denotes the number of the columns and a is the number which is reduced one from the square of the number of the columns. When a voltage is applied to both the line electrodes and the column electrodes, the voltage across the liquid crystal is $+V_0$ or $-V_0$ to turn ON and OFF the same. However, when the voltage (b) is applied to only the column electrode, the voltage across the liquid crystal assumes $$+\frac{1}{a}V_0 \text{ or } -\frac{1}{a}V_0$$

to render the same non-operative.

It is obvious that according to the present invention an even day display may be reversed from a negative to a positive or vice versa in a calender display (FIG. 2, 9). Otherwise, a sunday display may be provided in a different color (FIG. 2, 10) by a color polarizer.

The invention being thus described, it will be obvious that the same may be varied in many ways. Such modifications are not to be regarded as a departure from the spirit and scope of the invention, and all such modifications are intended to be included within the scope of the following claims.

What is claimed is:

1. A display device capable of displaying a plurality of display patterns, comprising:

a liquid crystal cell having an xy matrix electrode structure including a predetermined number of x electrodes and a predetermined number of y electrodes arranged in an opposed orientation relative to said x electrodes;

driving means for sequentially driving said liquid crystal cell by sequentially applying a voltage pulse to each of said predetermined number of x electrodes or to each of said predetermined number of y electrodes;

display pattern selecting means for selecting one of said plurality of display patterns for display purposes on said liquid crystal cell;

electrode selecting means for specifying a selected number of said electrodes being driven by said driving means for driving purposes in accordance with said one of said plurality of display patterns selected by said display pattern selecting means; and duty factor specifying means for selectively changing the period of time during which said voltage pulse is applied to each of said selected number of said electrodes specified by said electrode selecting means in accordance with the selected number of said electrodes specified by said electrode selecting means.

2. A display device in accordance with claim 1 wherein said duty factor specifying means selects a longer period of time during which said voltage pulse is applied to each of said selected number of said electrodes specified by said electrode selecting means in response to a decrease in the selected number of said electrodes specified by said electrode selecting means.

3. A display device in accordance with claim 1 wherein said duty factor specifying means selects a shorter period of time during which said voltage pulse is applied to each of said selected number of said electrodes specified by said electrode selecting means in response to an increase in the selected number of said electrodes specified by said electrode selecting means.

4. A display device in accordance with claim 1 wherein said driving means comprises:

line driving means for sequentially driving said predetermined number of x electrodes; and column driving means for sequentially driving said predetermined number of y electrodes in synchronism with the driving of said x electrodes by said line driving means.

5. A display device in accordance with claim 4 wherein said electrode selecting means specifies a selected number of x electrodes being driven by said line driving means in accordance with the display pattern selected by said display pattern selecting means.

6. A display device in accordance with claim 5 wherein said duty factor specifying means selectively changes the period of time during which said voltage pulse is applied to each of said selected number of x electrodes in accordance with the number of selected x electrodes specified by said electrode selecting means.

7. A display device in accordance with claim 4 wherein said display further comprises memory means for storing said plurality of display patterns therein, said display pattern selecting means selecting one of said plurality of display patterns stored in said memory means, said column driving means sequentially driving said predetermined number of y electrodes in accordance with the selected display pattern selected by said display pattern selecting means.

8. A display device in accordance with claim 7 wherein said electrode selecting means specifies a selected number of x electrodes being driven by said line driving means in accordance with the display pattern selected by said display pattern selecting means.

9. A display device in accordance with claim 8 wherein said duty factor specifying means selectively changes the period of time during which said voltage pulse is applied to each of said selected number of x electrodes in accordance with the number of selected x electrodes specified by said electrode selecting means.

* * * * *